US006341663B1

(12) United States Patent
Alex et al.

(10) Patent No.: US 6,341,663 B1
(45) Date of Patent: Jan. 29, 2002

(54) SILENCER WITH A SHUNT RESONATOR

(75) Inventors: Matthias Alex, Heilbronn; Rolf Fuesser, Bad Herrenalb, both of (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/555,054

(22) PCT Filed: Nov. 14, 1998

(86) PCT No.: PCT/EP98/07296

§ 371 Date: Jul. 18, 2000

§ 102(e) Date: Jul. 18, 2000

(87) PCT Pub. No.: WO99/27237

PCT Pub. Date: Jun. 3, 1999

(30) Foreign Application Priority Data

Nov. 27, 1997 (DE) ..... 197 51 940

(51) Int. Cl.[7] ..... F01N 1/02

(52) U.S. Cl. ..... 181/249; 181/255; 181/282

(58) Field of Search ..... 181/249, 250, 181/251, 255, 257, 266, 268, 272, 282

(56) References Cited

U.S. PATENT DOCUMENTS

| | | | | | |
|---|---|---|---|---|---|
| 2,765,044 | A | * | 10/1956 | Hatte | 181/250 |
| 4,209,076 | A | * | 6/1980 | Franco et al. | 181/272 |
| 4,446,942 | A | * | 5/1984 | Hardt et al. | 181/249 |
| 4,892,168 | A | * | 1/1990 | Sasaki | 181/250 |
| 5,545,860 | A | * | 8/1996 | Wilkes et al. | 181/255 |

* cited by examiner

*Primary Examiner*—Khanh Dang
(74) *Attorney, Agent, or Firm*—Crowell & Moring LLP

(57) ABSTRACT

The invention relates to a silencer. The silencer includes a sound conducting channel having two ends. An injection molded part is arranged between the two ends of the sound conducting channel and includes a plurality of pipe elements. A shunt resonator is arranged in fluid communication with the sound conducting channel by way of openings formed in the plurality of pipe elements. The shunt resonator defines a volume formed by two housing parts which are joined together. By varying the number, position, length and diameter of the pipe elements in the silencer, the silencer is capable of achieving silencing gains in different frequency ranges.

6 Claims, 1 Drawing Sheet

SILENCER WITH A SHUNT RESONATOR

BACKGROUND AND SUMMARY OF THE INVENTION

The invention relates to a silencer with a shunt resonator.

From the publication "Intake Silencing of Commercial Vehicles", Lothar Bending, ATZ, Apr. 4, 1978, it is already known that, at a silencer in the intake duct of an internal combustion engine, a particular longitudinal piece can be surrounded by an outer housing. In a region of the housing cover, the intake duct is partially perforated, as a result of which a volume formed between the intake duct and the outer housing is coupled acoustically.

It is therefore an object of the invention to construct a silencer of the type mentioned above in such a manner that the silencing behavior of the silencer can be calculated and influenced as a function of the sound frequency.

The silencer of the present invention is advantageously suitable to accomplish at least this objective by way of the features as described and claimed hereinafter. Since the acoustically effective openings in the intake duct comprise pipe elements which extend from the intake duct into the housing volume of the shunt resonator, it is possible to exert a positive effect on the silencing behavior by suitably dimensioning and arranging the pipe elements.

The modifiable pipe elements form openings in the intake duct which advantageously allow the shunt resonator, also referred to as a Helmholtz resonator, to be tuned simply for silencing even low frequencies.

The volume of the shunt resonator is defined by an annular space between the intake duct and the outer housing with the formation of an acoustic neck by the pipe elements assuming a position of prime importance. The number and position of the pipe elements as well as their length and their diameter are advantageously selected in such a manner that their acoustic silencing gains develop in a specified frequency range.

In order to also advantageously utilize so-called breaking-in frequencies with silencing losses on either side of the resonance frequency, the position of the pipe element in relation to the center of the shunt resonator can be shifted in the longitudinal direction in such a manner that the silencing losses are shifted by interaction with further components surrounding the silencer into frequency ranges at which the silencing losses are not disturbed. In the most advantageous case, this can lead to a silencing gain.

In the case of a particularly advantageous embodiment, the sound-carrying channel is the intake duct for the intake air of an internal combustion engine and the sound emissions, which are to be silenced, are produced by the intake pulses of the individual cylinders, especially of a diesel engine.

The silencer of the present invention can be produced in an advantageous manner owing to the fact that the region having the pipe elements in the sound-carrying channel is an injection molded part that can be inserted between two ends in the intake duct and that the enveloping housing volume of the shunt resonator formed by housing halves are mounted at each end of the duct and the two halves of the housing can be joined together permanently, enclosing the injection molded part.

In order to form the pipe elements with a simple design, the pipe elements can also be produced separately and attached and extrusion coated individually during the production of the injection-molded part.

Other objects, advantages and novel features of the present invention will become apparent from the following detailed description of the invention when considered in conjunction with the accompanying drawings.

BRIEF DESCRIPTION OF THE DRAWINGS

An example of the inventive silencer with a shunt resonator is explained in greater detail by means of the drawing, in which.

DETAILED DESCRIPTION OF THE DRAWINGS

Figure 1:
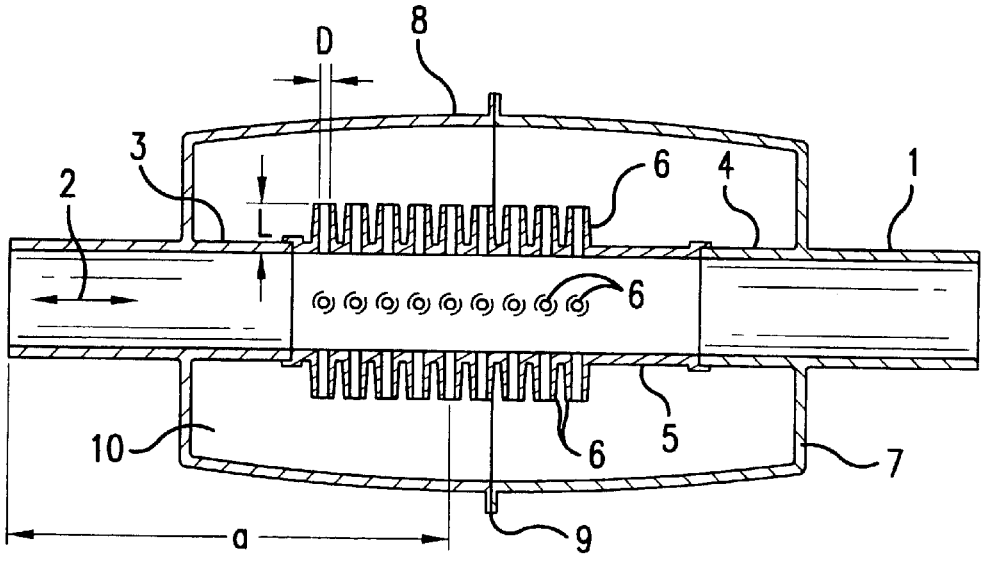
FIG. 1 shows a section through an intake duct for the intake air of an internal combustion engine with pipe elements in the shunt resonator.

In FIG. 1, the intake duct 1 is shown as a sound channel. Through it, intake air 2 is supplied to an internal combustion engine, the details of which are not explained. The intake duct 1 is interrupted at each end 3 and 4 and encloses an injection-molded part 5 which is provided with pipe elements 6 as sound-carrying openings. The injection-molded part 5 is surrounded by housing parts 7 and 8 which are permanently mounted at the pipe ends 3 and 4 and are tightly connected with one another at a seam site 9. The center of the region in which the pipe elements 6 are disposed is not located centrally within the housing parts 7 and 8. The dimension "a" representing a distance from the exciter side is shown as a reference value.

Figure 2:
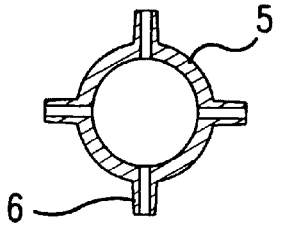
FIG. 2 shows a detailed section through the intake duct in the region of the pipe elements.

The volume of the housing between the housing parts 7 and 8 and the injection molded part 5, as well as the adjoining regions of the intake duct 1, form a shunt resonator 10 for the sound oscillations of the pulsating intake air. The way in which the inventive silencer functions is shown by means of FIG. 2, which shows the molded part 5 in section, and by means of FIG. 3, which shows a silencing diagram of the sound oscillations.

The silencing behavior of the arrangement, shown in FIG. 1, can be influenced by the number, the position and the dimensions of the pipe element 6. The basic formula for calculating the resonance frequency $f_{res}$ of the silencer is as follows.

$$f_{res}=340/2\pi/\sqrt{A/L/V}$$

wherein

A is the sum of the acoustically active area of the pipe elements 6,

L is the length of the pipe elements 6 and

V is the housing volume of the shunt resonator 10.

In addition to an enlargement of the housing volume V, an increasing length L of the pipe elements 6 can thus bring about a lowering of the resonance frequency $f_{res}$. This has advantages when used in internal combustion engines because the shunt resonator contributes predominantly in its resonance region and the high sound energies in the intake duct occur at relatively low frequencies.

The sum of all opening areas and, with that, the acoustically effective area A is obtained from the number of pipe elements 6 and the areas of each of the openings. The acoustically effective length is fixed as a whole by the length L of the individual pipe elements 6. Accordingly, for a given housing volume V, a fixed diameter D of the pipe elements 6 and an appropriately selected length L of the pipe elements 6, an optimum silencing range for the silencer can thus be adjusted.

Figure 3:
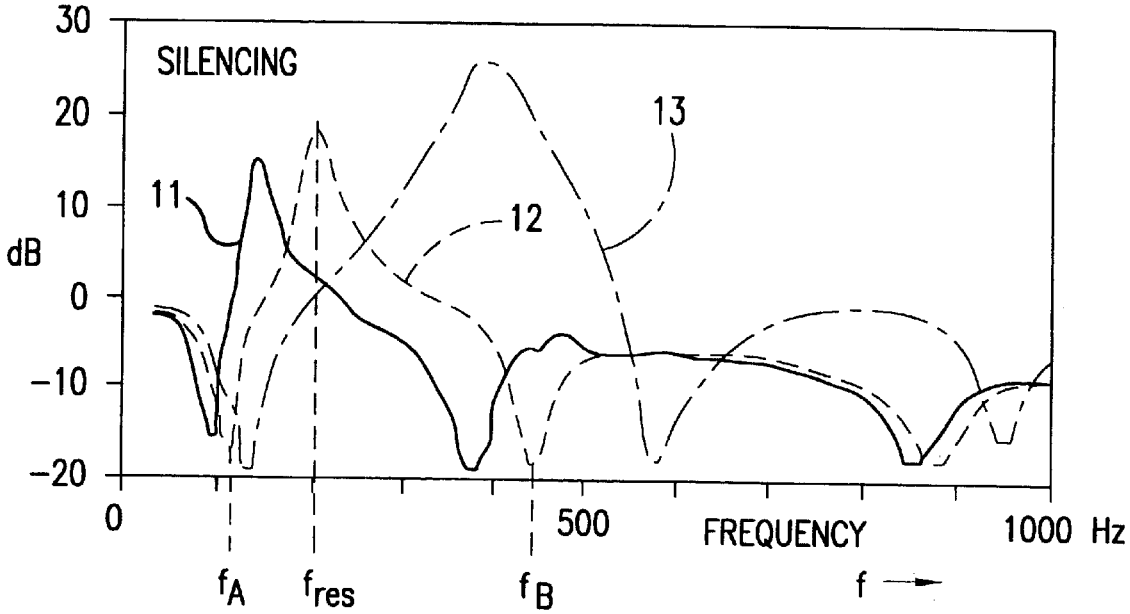
FIG. 3 shows a diagram of the silencing as a function of the frequency for different arrangements of the pipe elements.

In the diagram of FIG. 3, different embodiments of the arrangement with the pipe elements 6 are shown by way of example. The silencing in dB is plotted here as a function of the frequency f. In a curve 11, the silencing is shown for an arrangement with one row of pipe elements 6, in a curve 12, an arrangement with two rows of pipe elements 6 is shown and in a curve 13, an arrangement with six rows of pipe elements 6. From this, it can be seen that, as the number of rows with pipe elements 6 increases, the region of the silencing corresponding to the formula given above is almost directly proportional to the number of rows as it migrates to higher frequencies and, in so doing, becomes broader.

As also shown by the diagram of FIG. 3, aside from the gains in silencing, there are also losses with this arrangement. The position of the so-called break-in frequencies $f_A$ and $f_B$, at which the silencing losses occur, can be affected by the width and position of the region in which the pipe elements 6 are located in the intake duct 1 and within the shunt resonator 10.

Above all, the dimension "a", which is shown in FIG. 1, and the number z of pipe elements 6 can be changed here in such a way that the undesirable silencing losses are shifted into frequency ranges in which such losses are less disturbing. For example, if the number of rows z or the diameter D of the pipe elements 6 is increased, the resonance frequency $f_{res}$ increases because of the increased acoustically active area A. However, changing the position of the region of the pipe elements 6 from the central position in the shunt .resonator 10 does not have any effect on the resonance frequency $f_{res}$, which needs to be taken into consideration, but does have an effect on the position of the break-in frequencies $f_A$ and $f_B$. Of importance is the dimension "a", which indicates the position of the region of the pipe elements 6 relative to the exciter side in the intake duct 1.

Arrangements of the inventive shunt resonator of the type described above are used in intake systems which have a plurality of further components which can mutually affect one another. In such complex systems, a shunt resonator 10 can have the surprising effect of a desirable silencing instead of a sound amplification even at certain frequency positions with silencing losses. If, as in the inventive example, this effect can be calculated and, with that, influenced, this can be utilized in an advantageous manner.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A silencer comprising:

a sound conducting channel comprising two ends;

an injection molded part arranged between the two ends of the sound conducting channel and comprising a plurality of pipe elements; and a shunt resonator in fluid communication with the sound conducting channel by way of openings formed in the plurality of pipe elements;

wherein the shunt resonator defines a volume formed by two housing parts which are joined together.

2. The silencer according to claim 1, wherein at least one of a number, position, length and diameter of the pipe elements are capable of being altered to achieve silencing in different frequency ranges.

3. The silencer according to claim 1, wherein a center position of the pipe elements is capable of being altered in relation to a center position of the shunt resonator in a longitudinal direction of the silencer such that silencing losses can be changed to a silencing gain within a particular frequency range.

4. The silencer according to claim 1, wherein the sound conducting channel is an intake duct for intake air of an internal combustion engine, and sounds silenced by the silencer are intake pulses from cylinders of the internal combustion engine.

5. The silencer according to claim 4, wherein the internal combustion engine is a diesel engine.

6. The silencer according to claim 1, wherein the plurality of pipe elements are produced separately, and are attached and extrusion coated individually during manufacture of the injection molded part.

* * * * *